US011885603B2

(12) United States Patent
Haas

(10) Patent No.: US 11,885,603 B2
(45) Date of Patent: Jan. 30, 2024

(54) CONNECTOR COUPLING AN ARROWHEAD AND ARROW SHAFT

(71) Applicant: FERADYNE OUTDOORS, LLC, Superior, WI (US)

(72) Inventor: Matthew Haas, Duluth, MN (US)

(73) Assignee: FeraDyne Outdoors, LLC, Superior, WI (US)

( * ) Notice: Subject to any disclaimer, the term of this patent is extended or adjusted under 35 U.S.C. 154(b) by 21 days.

(21) Appl. No.: 17/613,906

(22) PCT Filed: May 4, 2020

(86) PCT No.: PCT/US2020/070022

§ 371 (c)(1),
(2) Date: Nov. 23, 2021

(87) PCT Pub. No.: WO2020/237250

PCT Pub. Date: Nov. 26, 2020

(65) Prior Publication Data

US 2022/0228844 A1 Jul. 21, 2022

Related U.S. Application Data

(60) Provisional application No. 62/852,146, filed on May 23, 2019.

(51) Int. Cl.
*F42B 6/08* (2006.01)
*F42B 6/04* (2006.01)

(52) U.S. Cl.
CPC . *F42B 6/04* (2013.01); *F42B 6/08* (2013.01)

(58) Field of Classification Search
CPC ..... F42B 6/04; F42B 6/06; F42B 6/08
See application file for complete search history.

(56) References Cited

U.S. PATENT DOCUMENTS

| | | | | |
|---|---|---|---|---|
| 5,234,220 | A | 8/1993 | Schellhammer et al. | |
| 5,611,542 | A | 3/1997 | Saunders | |
| 6,217,467 | B1 * | 4/2001 | Maleski | F42B 6/08 473/583 |
| 7,955,201 | B2 * | 6/2011 | Harwath | F42B 6/04 473/585 |
| 9,410,774 | B1 | 8/2016 | Gallo | |
| 9,638,499 | B2 * | 5/2017 | Perry | F42B 6/04 |
| 2008/0207362 | A1 * | 8/2008 | Kuhn | F42B 10/24 473/586 |
| 2017/0067723 | A1 * | 3/2017 | Pedersen | B29C 45/0013 |
| 2017/0299353 | A1 * | 10/2017 | Greenwood | F42B 6/04 |

FOREIGN PATENT DOCUMENTS

| | | | |
|---|---|---|---|
| WO | 89-03012 | A1 | 4/1989 |
| WO | 2016-028863 | A1 | 2/2016 |

OTHER PUBLICATIONS

International Search Report and Written Opinion, issued by the ISA/KR Korean Intellectual Property Office, regarding correspondence patent application Serial No. PCT/US2020/070022; dated Aug. 25, 2020.

* cited by examiner

*Primary Examiner* — John A Ricci
(74) *Attorney, Agent, or Firm* — Greenberg Traurig, LLP

(57) ABSTRACT

A connector for coupling an arrow shaft and an arrowhead to each other includes an insert configured for coupling with the arrow shaft and an outsert configured for coupling with an arrowhead.

20 Claims, 3 Drawing Sheets

CONNECTOR COUPLING AN ARROWHEAD AND ARROW SHAFT

CROSS-REFERENCE TO RELATED APPLICATIONS

This application is a national stage of International Patent Application No.: PCT/US2020/070022, filed on May 4, 2020; which claims the benefit of U.S. Provisional Patent Application No. 62/852,146, filed May 23, 2019, which are herein incorporated by reference in their entirety.

STATEMENT REGARDING FEDERALLY SPONSORED RESEARCH OR DEVELOPMENT

Not applicable.

TECHNICAL FIELD

The instant disclosure relates to a connector. In particular, this disclosure pertains to a connector for coupling an arrow shaft and a point or arrowhead to each other.

BACKGROUND

Inserts enable an archer to affix different types of points and arrowheads to an arrow shaft. A typical insert is configured to fit inside the shaft and includes threads for attaching a point or arrowhead to the shaft. The Archery Trade Association (ATA; formerly Archery Manufacturers and Merchants Organization (AMO)) standards dictate that inserts must have a 8-32 female thread for attaching a point or arrowhead to the shaft. Shafts for arrows and crossbow bolts having an inside diameter of 0.166" have become increasingly popular. However, this diameter is too small for a 8-32 thread insert, and manufacturers have had to develop other means of attaching points and arrowheads to shafts. One alternative means for attaching points and arrowheads to shafts is an "outsert" which slides over the outside surface of the shaft, and includes threads for attaching points and arrowheads.

U.S. Pat. No. 9,638,499 to Perry teaches an insert/outsert assembly for an arrow. The insert includes a cylindrical body having first and second ends. The second end of the insert is dimensioned to fit within the bore of an arrow shaft. The first end includes a prong containing male threads. The outsert includes a cylindrical wall with an arrowshaft end and an arrowhead end. A center bore extends between the arrowshaft and arrowhead ends. The center bore contains a threaded region with female threads located intermediate of the arrowhead end and arrowshaft end. The insert is threadedly connected to the outsert. An arrowhead is threadedly connected to the outsert.

SUMMARY

A non-limiting exemplary embodiment of a connector for coupling an arrow shaft and an arrowhead to each other includes an insert and an outsert. The insert includes a first section, a second section, and a collar between the first and second sections. The first section of the insert includes an outer surface configured for coupling with an inner surface of a bore of an arrow shaft, and the second section is configured for coupling the insert to the outsert. The outsert includes an arrow shaft section and an arrowhead section as discrete sections in the outsert. The arrowhead section is configured for coupling with an arrowhead. The arrow shaft section includes an arrow shaft compartment and an insert compartment. The arrow shaft compartment includes an inner surface configured for coupling with an outer surface of the arrow shaft. The insert compartment is configured for coupling with the second section of the insert.

DETAILED DESCRIPTION

One or more non-limiting exemplary embodiments are disclosed herein with reference to the accompanying drawings, wherein like numerals indicate like, but not necessarily identical, elements. It should be clearly understood that the embodiments described with reference to the drawings are merely exemplary in that any one or more of them may be implemented in alternative manner as may become apparent to a person of ordinary skills. The figures, wherein some features may have been exaggerated or minimized to illustrate details of particular components, are not necessarily to scale. Specific structural and/or functional features and details disclosed herein are not to be construed as limiting but should rather be considered as a basis for teaching one of ordinary skills. There is no intent, implied or otherwise, to limit the disclosure in any way, shape or form to the embodiments illustrated and described herein. Accordingly, any and all variants for providing structures and/or functionalities similar to those described herein are considered as being within the metes and bounds of the instant disclosure.

Figure 1:
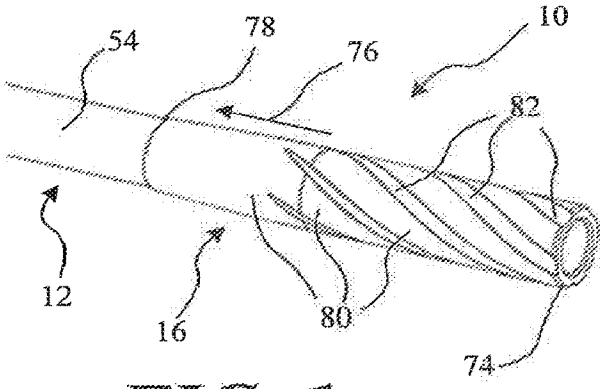
FIG. 1 is a perspective view of a non-limiting exemplary embodiment of a connector of the instant disclosure installed on a shaft of an arrow.
Figure 2:
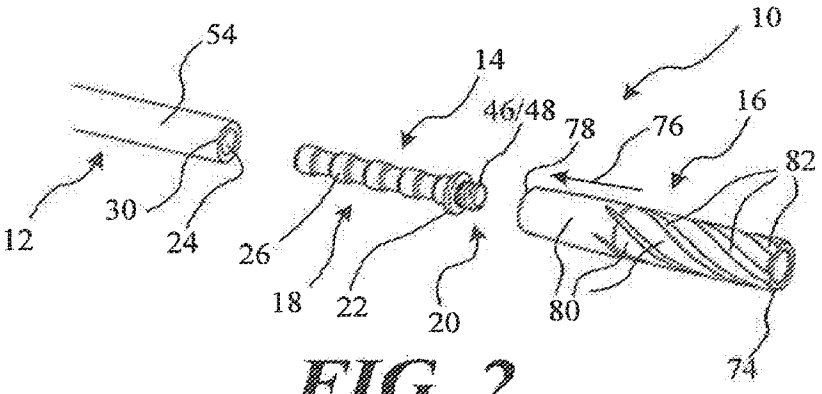
FIG. 2 is a perspective view of the connector of FIG. 1 in a disassembled state.
Figure 3:
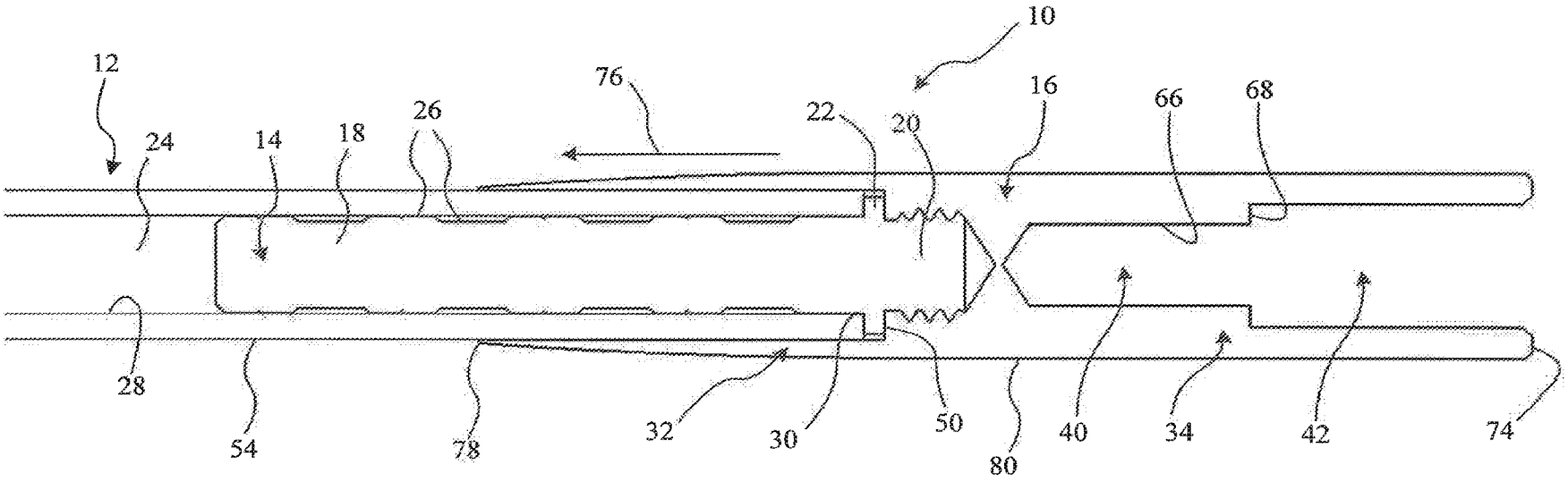
FIG. 3 is a cross-sectional view the connector of FIG. 1.

FIGS. 1 and 2 are perspective views of a non-limiting exemplary embodiment of a connector 10. In FIG. 1, the connector 10 is illustrated installed at an end of an arrow shaft 12, and in FIG. 2, the connector 10 is illustrated in a disassembled and uninstalled state. FIG. 3 is a cross-sectional view of the connector 10 and the shaft 12 illustrated in FIG. 1.

In a non-limiting exemplary embodiment, the connector 10 includes an insert 14 and an outsert 16. In some embodiments, the insert 14 is configured for coupling with or attachment to the shaft 12, and the outsert 16 is configured for attaching or coupling the shaft 12, having the insert 14, to an arrowhead.

Figure 4:
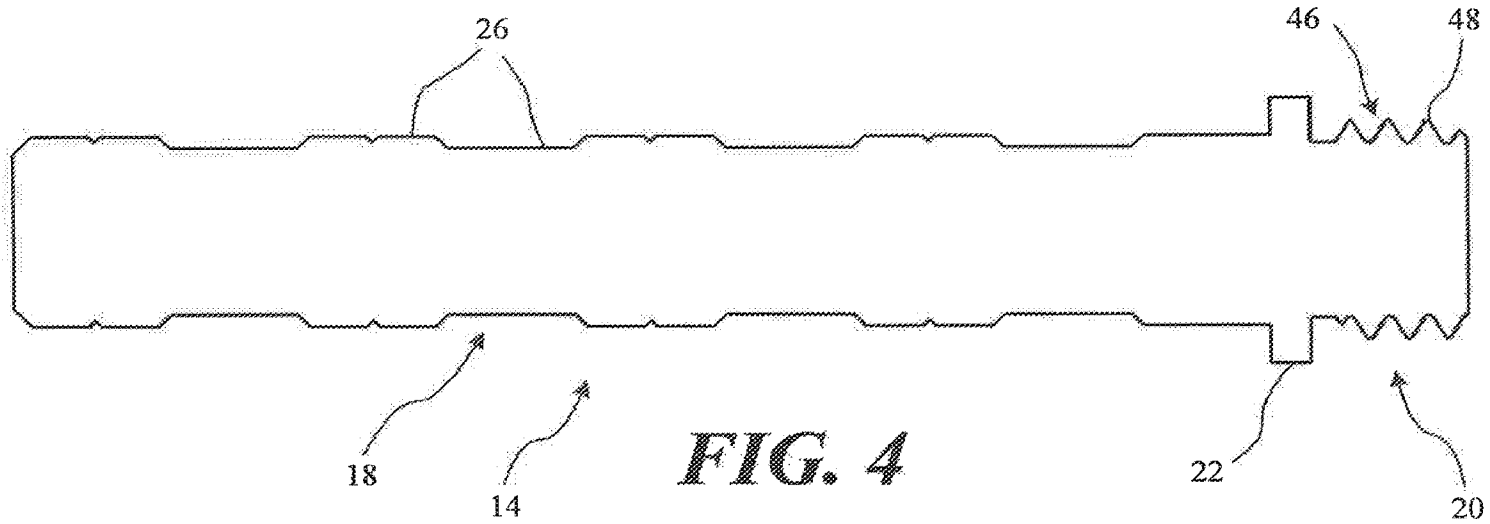
FIG. 4 is a cross-sectional view of a non-limiting exemplary embodiment of an insert for the connector of the instant disclosure.

FIG. 4 is a cross-sectional view of a non-limiting exemplary embodiment of the insert 14. In some embodiments, the insert 14 is defined at least in part by a first section 18, a second section 20, and a collar (or washer or stop) 22 between the first and second sections 18 and 20. In certain embodiments, the first section 18 is configured for being installed in (or coupled to or attached to) a bore 24 of the shaft 12. In some embodiments, the first section 18 is defined at least in part by an outer surface 26 which couples to or abuts an inner surface 28 of the shaft 12 when first section 18 of the insert 14 is installed in, i.e., inserted into, the bore 24 of the shaft 12. (see FIG. 3 for example) In certain embodiments, the insert 14, more specifically the first section 18, and the shaft 12 are fixedly coupled (or attached) to each other using techniques and material well known in the art, such as for example adhesive or glue. In some embodiments, the insert 14 and the shaft 12 are removably coupled (or attached) to each other, such as for example via a friction fit or threads. In certain embodiments, the entirety of the first section 18 is positioned within the bore 24 such that an end 30 of the arrow shaft 12 abuts the collar 22. In some embodiments, the outer surface 26 of the insert 14 is not smooth, i.e., it includes dents or channels or pockmarks and the like, for enhancing the coupling or attaching the arrow shaft 12 and the insert 16 to each other, for example increasing the surface area for an adhesive used for the coupling.

Figure 5:
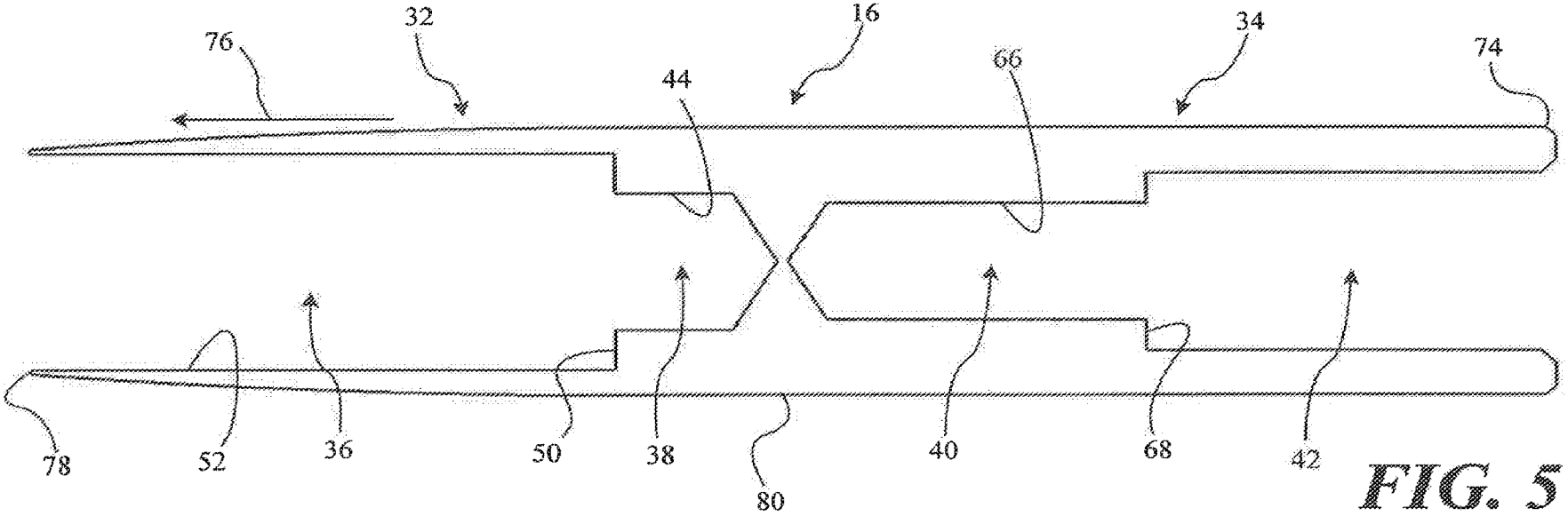
FIG. 5 is a cross-sectional view of a non-limiting exemplary embodiment of an outsert for the connector of the instant disclosure.

FIG. 5 illustrates a non-limiting exemplary embodiment of the outsert 16. In some embodiments, the outsert 16 is defined at least in part by an arrow shaft section 32 and an arrowhead section 34. In certain embodiments, the arrow shaft section 32 includes an arrow shaft compartment 36 and an insert compartment 38, and the arrowhead section 34 includes an attachment compartment 40 and a support compartment 42.

In some embodiments the insert compartment 38 and the second section 20 of the insert 14 are configured for being coupled with or attached to each other. In certain embodiments, at least portions of the insert compartment 38 and the second section 20 have complimentary threads on their respective inner and outer surfaces 44 and 46 for coupling or attaching the insert 14 and the outsert 16 to each other. In some embodiments, threads 48 are disposed on at least a portion of the outer surface 46 of the second section 20 of the insert 14. In certain embodiments, the threads 48 are self-tapping threads that thread into an unthreaded portion of the inner surface 44 of the insert compartment 38. In some embodiments, though not shown, self-tapping threads are disposed on at least a portion of the inner surface 44 of the insert compartment 38 that thread into an unthreaded portion of the outer surface 46 of the second section 20. Accordingly, the insert 14 and the outsert 16 are threadedly coupled or attached to each other. In certain embodiments, the insert compartment 38 of the outsert 16 and the second section 20 of the insert 14 are fixedly coupled or attached to each other.

In some embodiments, the arrow shaft section 32 of the outsert 16 includes a ledge 50 extending between the arrow shaft compartment 36 and the insert compartment 38. In certain embodiments, the ledge 50 and the collar 22 abut when the insert 14 and the outsert 16 are coupled or attached to each other. In some embodiments, the ledge 50 functions as a "stop" for inhibiting the second section 20 of the insert 14 from further penetration into the insert compartment 38 of the outsert 16. In certain embodiments, the ledge 50 operates to eliminates or minimizes stripping the threads.

In certain embodiments, the arrow shaft 12 and the connector 10 are configured for coupling with each other. In some embodiments, an end section of the arrow shaft 12 and the arrow shaft compartment 36 are configured for providing a snug fit between the arrow shaft 12 and the connector 10. In certain embodiments, the arrow shaft compartment 36 of the outsert 16 includes an inner surface 52 which abuts or couples with at least a portion of an outer surface 54 of the shaft 12 when the insert 14 is attached or coupled to the outsert 16. (see FIG. 3 for example) In some embodiments, the arrow shaft compartment 36 and the shaft 12 are removably coupled to each other. In other embodiments, a friction fit couples or attaches the arrow shaft compartment 36 and the shaft 12 to each other. In certain embodiments, the coupling is threaded. In certain embodiments, the arrow shaft compartment 36 and the shaft 12 are fixedly coupled or attached to each other.

Figure 7:
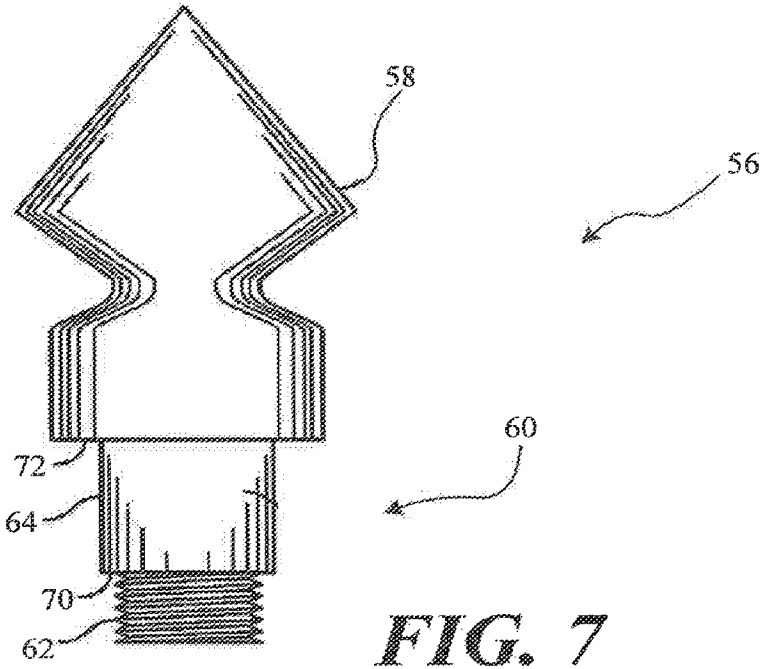
FIG. 7 is an elevational view of a non-limiting exemplary embodiment of an arrowhead.

FIG. 7 is a cross-sectional view of a non-limiting exemplary embodiment of an arrowhead 56. In some embodiments, the arrowhead 56 includes a target penetrating section 58 and a shank 60 extending away from the target penetrating section 58. In certain embodiments, the target penetrating section 58 is any one of the numerous projectile points as are well known in the art, such as for example but not limited to a broadhead, a practice point, a target point, a field point, a blunt, among others. As is well known in the art, the shank 60 is used for attaching the arrowhead 56 to a shaft of an arrow. In some embodiments, the shank 60 is used for attaching the arrowhead 56 and the connector 10 to each other. More specifically, the shank 60 is used for attaching the arrowhead 56 and the arrowhead section 34 of the outsert 16. In some embodiments, the entirety of the shank 60 is unthreaded. In certain embodiments, the entirety of the shank 60 is threaded. In other embodiments, such as illustrated in FIG. 7 for example, the shank 60 has a first section 62 and a second section 64.

In some embodiments, the attachment compartment 40 in the arrowhead section 34 of the outsert 16 and the first section 62 of the shank 60 of the arrowhead 56 are configured for being coupled or attached to each other. In certain embodiments, at least a portion of the attachment compartment 40 and the first section 62 have complementary threads. In some embodiments, the threads on the first section 62 are self-tapping threads that thread into an unthreaded portion of an inner surface 66 of the attachment compartment 40. In certain embodiments, though not shown, self-tapping threads are disposed on the inner surface 66 of the attachment compartment 40 that thread into the outer surface of the unthreaded first section 62.

In some embodiments, the support compartment 42 in the arrowhead section 34 of the outsert 16 is configured for receiving or housing the second section 64 of the shank 60. In certain embodiments, the support compartment 42 and the second section 64 are removably coupled or attached to each other. In some embodiments, a snug fit couples or attaches the support compartment 42 and the second section 64 to each other. In certain embodiments, a friction fit holds the support compartment 42 and the second section 64 together. In other embodiments, the support compartment 42 and the second section 64 include complementary threads for coupling or attachment. In some embodiments, either the support compartment 42 or the second section 64 include self-tapping threads that thread into the unthreaded surface of the other. In other embodiments, the support compartment 42 and the second section 64 are fixedly coupled or attached to each other.

In some embodiments, the arrowhead section 34 of the outsert 16 includes a ledge 68 extending between the attachment compartment 40 and the support compartment 42, and the second section 64 of the shank 60 has a "shoulder" or "ledge" 70. In certain embodiments, the ledge 68 and the shoulder 70 abut when the arrowhead 56 and the outsert 16 are coupled or attached to each other. In some embodiments, the ledge 68 functions as a "stop" for inhibiting the first section 62 of the arrowhead 56 from further penetration into the attachment compartment 40 of the outsert 16. In certain embodiments, the ledge 68 operates to eliminates or minimizes stripping the threads.

In some embodiments, the arrowhead 56 includes a shoulder 72 at the base of the target penetrating section 58 from which the shank 60 extends. In certain embodiments, the shoulder 72 and an end 74 of the arrowhead section 34 abut when the outsert 16 and the arrowhead 56 are coupled or attached to each other. In certain embodiments, the shoulder 72 functions as a "stop" for inhibiting the first section 62 of the arrowhead 56 from further penetration into the attachment compartment 40 of the outsert 16.

Figure 6:
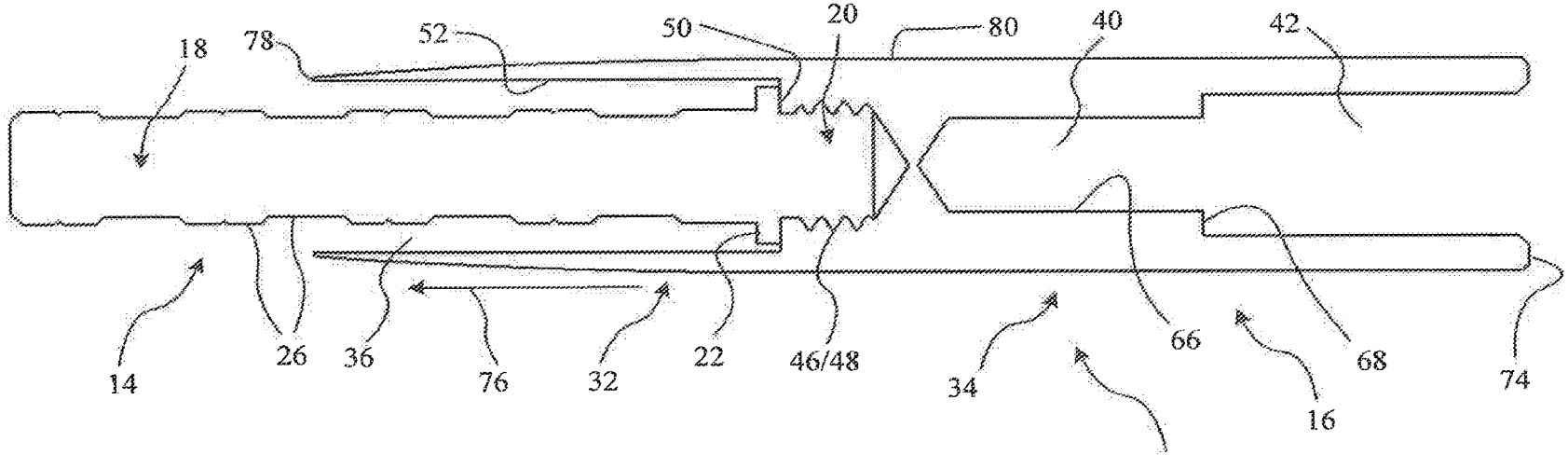
FIG. 6 is a cross-sectional view of the connector of FIG. 3 without the shaft of the arrow.

In a non-limiting exemplary embodiment, such as that illustrated in FIGS. 3, 5 and 6 for example, the arrow shaft section 32 and the arrowhead section 34 of the outsert 16 are discrete sections. In some embodiments, the arrow shaft section 32 and the arrowhead section 34 may be physically or structurally connected or attached at their respective internal ends within the outsert 16, there is no opening therebetween. In certain embodiments, a bar or a rod or a pillar or a similar reinforcement structure extends between the respective internal ends of the arrow shaft section 32 and the arrowhead section 34 within the outsert 16. In some embodiments, an opening or a channel or a conduit or a similar structure extends between the respective internal ends of the arrow shaft section 32 and the arrowhead section 34 within the outsert 16. However, it should be clearly understood that any such opening or channel or conduit or similar structure is configured to inhibit the second section 20 of the insert 14 from entering the attachment compartment 40 of the outsert 16 and to inhibit the first or second sections 62 and 64 of the arrowhead 56 from entering the insert compartment 38 of the outsert 16.

In a non-limiting exemplary embodiment, the outsert 16 has an inwardly tapering profile as it extends towards the arrow shaft 12, i.e., in the direction indicated by the reference arrow 76. In some embodiments, an end 78 of the outsert 16 is substantially flush with the outer surface 54 of the arrow shaft 12.

In a non-limiting exemplary embodiment, at least a portion of an outer surface 80 of the outsert 16, i.e., connector 10, includes a plurality of non-linear furrows or grooves or channels 82. In some embodiments, the furrows 82 have aerodynamic characteristics. In certain embodiments, the furrow 82 are configured for eliminating or minimizing drag on the arrow during flight. In some embodiments, the curvature of the furrows 82 is substantially similar to the direction in which the arrow rotates upon release. In certain embodiments, the rate of curvature of the furrows 82 is substantially similar to the rate at which the arrow rotates upon release. In other embodiments, the furrows are linear.

In view thereof, modified and/or alternate configurations of the non-limiting exemplary embodiments illustrated and described herein may become apparent or obvious to one of ordinary skill. All such variations are considered as being within the metes and bounds of the instant disclosure. For instance, while reference may have been made to particular feature(s) and/or function(s), this disclosure is considered to also encompass any and all equivalents providing functionalities similar to those described herein with reference to the accompanying drawings. Accordingly, the spirit, scope and intent of the instant disclosure embraces all variations. Consequently, the metes and bounds of the instant disclosure are defined by the appended claims and any and all equivalents thereof.

What is claimed is:

1. A connector, comprising:

an insert comprising:

a first section comprising an outer surface configured for coupling with an inner surface of a bore of an arrow shaft;

a second section; and a collar between the first section and the second section; and an outsert comprising:

an arrow shaft section comprising:

an arrow shaft compartment comprising an inner surface configured for coupling with an outer surface of the arrow shaft; and an insert compartment configured for coupling with the second section of the insert; and an arrowhead section configured for coupling with an arrowhead;

wherein the arrow shaft section and the arrowhead section are discrete sections of the outsell, wherein a portion of the outsert extends between the arrow shaft section and the arrowhead section, wherein the portion separates the arrowhead section from the arrow shaft section such that there is no opening between the arrow shaft section and the arrowhead section.

2. The connector of claim 1, wherein the insert and the arrow shaft are fixedly coupled to each other.

3. The connector of claim 1, wherein the insert and the arrow shaft are removably coupled to each other.

4. The connector of claim 1, wherein the arrow shaft and the collar of the insert abut when the insert and the arrow shaft are coupled to each other.

5. The connector of claim 1, wherein the second section of the insert and the insert compartment of the outsert comprise complementary threads for coupling the insert and the outsert to each other.

6. The connector of claim 1, wherein either the second section of the insert or the insert compartment of the outsert comprises self-tapping threads for coupling the insert and the outsert to each other.

7. The connector of claim 1, comprising a ledge extending between the arrow shaft compartment and the insert compartment, wherein the collar of the insert and the ledge abut when the insert and the outsert are coupled to each other.

8. The connector of claim 1, wherein the arrowhead section of the outsert comprises:

an attachment compartment; and a support compartment.

9. The connector of claim 8, wherein the attachment compartment of the arrowhead section and at least a portion of a shank of the arrowhead comprise complementary threads for coupling the outsert and the arrowhead to each other.

10. The connector of claim 8, wherein either the attachment compartment of the arrowhead section or at least a portion of a shank of the arrowhead comprises self-tapping threads for coupling the outsert and the arrowhead to each other.

11. The connector of claim 8, wherein a first section of a shank of the arrowhead is housed within the support compartment of the arrowhead section and a second section of the shank of the arrowhead and the attachment compartment of the arrowhead section are coupled to each other when the outsert and the arrowhead are coupled to each other.

12. The connector of claim 8, wherein the arrowhead section of the outsert comprises a ledge extending between the attachment compartment and the support compartment.

13. The connector of claim 12, wherein the ledge and at least a portion of a shank of the arrowhead abut when the outsert and the arrowhead are coupled to each other.

14. The connector of claim 1, wherein at least a portion of an outer surface of the outsert comprises a plurality of non-linear furrows.

15. The connector of claim 14, wherein the plurality of non-linear furrows is configured for eliminating or minimizing drag during flight.

16. The connector of claim 14, wherein the plurality of non-linear furrows has aerodynamic characteristics.

17. The connector of claim 1, wherein the outsert comprises an inwardly tapering profile along at least a portion of its length.

18. The connector of claim 17, wherein an end of the outsert is substantially flush with the outer surface of the arrow shaft.

19. The connector of claim 1, wherein the outsert and the arrowhead are removably coupled to each other.

20. The connector of claim 1, wherein the outsert and the arrowhead are fixedly coupled to each other.

* * * * *